United States Patent [19]

Hallikas et al.

[11] Patent Number: 4,592,521

[45] Date of Patent: Jun. 3, 1986

[54] DEVICE FOR GUIDING A CABLE ONTO A REEL

[75] Inventors: Erkki T. Hallikas, Helsinki, Finland; Lennart Lindström, Vällingby, Sweden

[73] Assignee: Oy Nokia AB, Helsinki, Finland

[21] Appl. No.: 673,478

[22] Filed: Nov. 20, 1984

[30] Foreign Application Priority Data

Nov. 22, 1983 [FI] Finland ..... 834272

[51] Int. Cl.[4] ..... B65H 54/28

[52] U.S. Cl. ..... 242/158 R; 242/158.4 R

[58] Field of Search ..... 242/158 R, 158.2, 158.3, 242/158.4 R, 158 F, 158.4 A, 25 R, 157.1

[56] References Cited

U.S. PATENT DOCUMENTS

| | | | |
|---|---|---|---|
| 3,951,355 | 4/1976 | Morioka et al. | 242/158 R |
| 3,997,128 | 12/1976 | Hara et al. | 242/158 R X |
| 4,143,834 | 3/1979 | Hara et al. | 242/158.4 R X |
| 4,150,801 | 4/1979 | Ikegami et al. | 242/158 R |
| 4,421,284 | 12/1983 | Pan | 242/158 R |

*Primary Examiner*—Stanley N. Gilreath
*Attorney, Agent, or Firm*—Scully, Scott, Murphy & Presser

[57] ABSTRACT

A guiding device for a distributor for winding a cable on a flanged reel, which guiding device (6) comprises a traverse tube (17) supported by a traversing device (3) of the distributor for reciprocating the tube between the flanges of the reel. The tube forms a path of movement (L) for guiding the cable (5) to a free end of the traverse tube. A guide head (20) is provided at the free end of the traverse tube for guiding the path of movement of the cable with respect to the flanges (11, 12) of the reel (9). The guide head comprises at least one guide surface (24) eccentrically positioned with respect to the path of movement for contacting the flange of the reel. The horizontal distance of the guide surface from the path of movement is equal to one and a half times the diameter of the cable to be wound in a first rotation position of the guide tube and to half the diameter of the cable in a second rotation position of the guide tube.

9 Claims, 18 Drawing Figures

DEVICE FOR GUIDING A CABLE ONTO A REEL

BACKGROUND OF THE INVENTION

This invention relates to a guiding device for a distributor for winding a cable on a flanged reel, which guiding device comprises

- a traverse arm supported by a traversing device of the distributor, said arm comprising
- a supporting means forming a path of movement for guiding the cable to a free end of the traverse arm, and
- a guiding means provided at said free end of the traverse arm for displacing said path of movement of the cable with respect to the flanges of the reel,
- whereby the traverse arm is mounted on the traversing device rotatably around said path of movement of the cable.

When winding a cable on a reel, a distributor is used for guiding the cable to be positioned between the flanges of the reel in successive layers formed by adjacent revolutions. A guiding device provided in the distributor is supported by a traverse arm to extent between the flanges of the reel and is displaced to and fro from flange to flange by a traversing device of the distributor, when the cable is wound around the rotated reel. The object of the guiding device is to ensure that the cable is wound in regular layers in which the revolutions are situated accurately side by side following each other. It has proved difficult to wind the cable around the reel in the vicinity of the flanges, especially in deformed reels with twisted flanges. In this kind of reels, the cable tends to form gaps between the cable and the flange and to "climb" too early up on the preceding revolution beside the flange, thereby forming a protrusion at said point. All this disturbs a regular winding of the cable on the reel. The guiding device is intended to provide a positive guiding of the cable to a proper position with respect to the flanges of the reel.

U.S. Pat. No. 3,951,355 discloses a distributor which is provided with a guiding device for guiding the winding of a cable. The guiding device comprises a traverse arm supported by a traversing device, whereby the cable passes along one side of said arm towards the end thereof. A number of rolls provided with peripheral grooves and serving as supporting means are mounted for the cable at the end of the traverse arm. The support rolls are pressed against the cable from opposite sides, thus determining the path of movement of the cable. In addition, a press roll is mounted at the end of the traverse arm, which roll presses the cable sideways against the flange of the reel or the preceding cable revolution. Further, a detector of a capacitance type is provided at the end of the traverse arm, which detector detects the vicinity of the flange without contacting said flange and sends electrically proper guiding impulses to the traversing device for the traverse arm.

The most important disadvantage of the known guiding device is that the guiding head of the device is of a complex construction as well as liable to damage. The rolls guiding the cable must be accurately mounted on the traverse arm without any clearance and each cable size requires roll provided with peripheral grooves of a corresponding size. The same applies to the press roll of the traverse arm. Both the rolls and the detector project from the side of the traverse arm towards the flange of the reel. This causes a risk that a protruding board or other distortion of the flange of a deformed wooden reel may hit the set of rolls during the rotation of the reel, thus causing damage to the rolls and the detector.

SUMMARY OF THE INVENTION

The object of this invention is to provide a guiding device which avoids the above disadvantages and enables regular winding of a cable even on a deformed reel. This object is achieved by means of a guiding device according to the invention, which is characterized in that the guiding means of the traverse arm comprises at least one guide surface eccentrically positioned with respect to said path of movement for contacting the flange of the reel, whereby the horizontal distance of said guide surface from said path of movement is equal to one and a half times the diameter of the cable to be wound in a first rotated position of the traverse arm and to half the diameter of the cable in a second rotated position of the traverse arm.

The invention is based on the idea that the flange itself guides the traverse arm by means of a mechanical contact between said arm and said flange in the vicinity of each of the two flanges of the reel. The contact between the traverse arm and the flange is maintained not only during the first revolution of the cable i.e. the revolution nearest the flange, but also during the following revolution, whereby the traverse arm can be spaced apart from the flange a distance equal to the diameter of the cable by means of said guide surface so that when the first revolution has been completed, the cable can be positively displaced so as to be wound accurately beside the first revolution. It is often difficult for the cable to automatically follow the course of the preceding revolution beside the flanges, where the end portion of the cable is positioned or passes through the flange up on the drum of the reel and where the last revolution of a lower layer runs up on said layer in order to form the first revolution of the following layer. Because the traverse arm follows the flange by means of a mechanical contact, it is ensured that the cable is guided to run accurately along the desired path with respect to the flange also in deformed reels, and, further, to be displaced up on the correct revolution at such difficult points as mentioned above. Consequently, the guiding device does not require any detector nor any electric circuit or sensing of the angle movement of the reel in order to guide the cable in the vicinity of the flanges. After the second revolution of each layer has been properly started, the traverse arm stops to follow mechanically the flange and begins to guide the winding of the cable by means of the normal distribution control of the traversing device.

The traverse arm is capable of following also a deformed twisted flange and the guide surface of said arm is not susceptible to pushes or strikes, because it does not comprise any projecting parts and because the surface of the required eccentric element can be bevelled where necessary.

It is advantageous that the traverse arm is formed by a tube, in which the cylindrical hole of the tube forms a guideway for the cable to be wound. No rolls which are difficult to manufacture are thus required for guiding the cable winding but a simple tube will suffice. Such simple tubes having different diameters and corresponding simple eccentric elements can without any major costs be kept in storage for cables of different sizes. Replacing one guide tube with another is an extremely simple operation.

BRIEF DESCRIPTION OF THE DRAWINGS

The invention is described more closely in the following with reference to the enclosed drawings, wherein FIGS. 7A–12A and 7B–12B illustrate a reel to be wound in an axial section and in a corresponding top view in six different winding stages of the cable and the traverse arm.

DETAILED DESCRIPTION OF THE PREFERRED EMBODIMENTS

Figure 1:
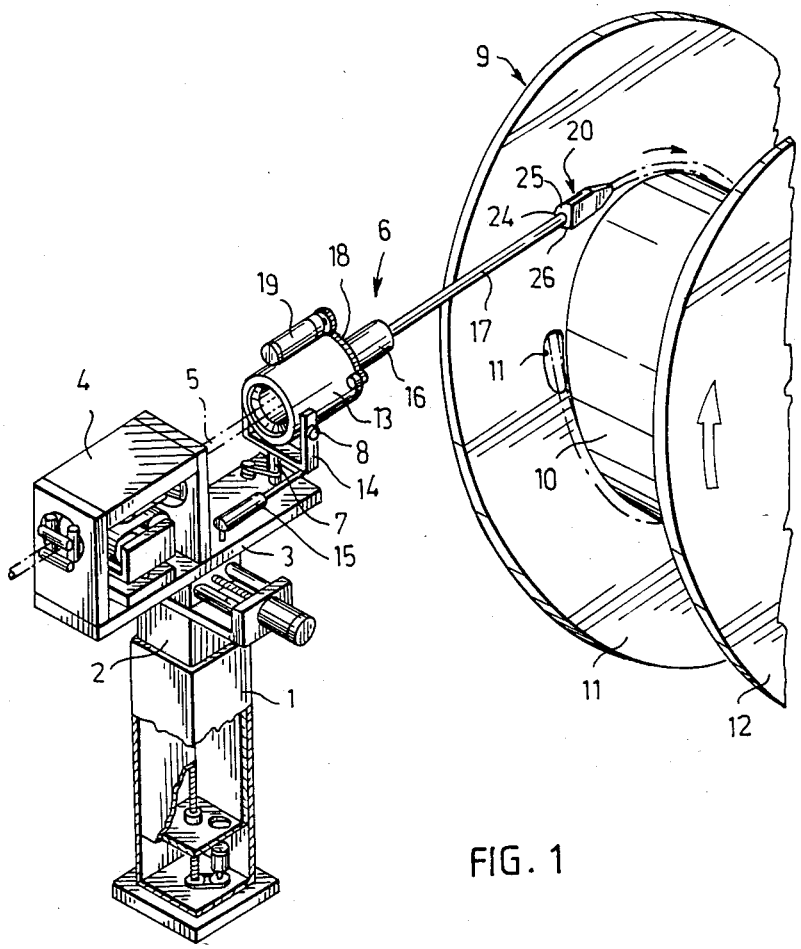
FIG. 1 is a perspective view of a distributor provided with a guiding device according to the invention and a reel to be wound.
Figure 2:
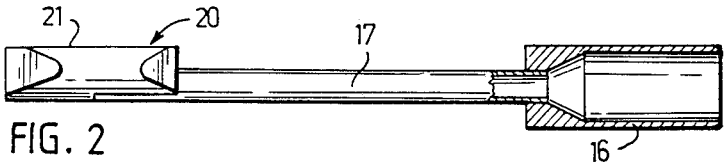
FIG. 2 is an enlarged side view of one preferred embodiment of the guiding device.
Figure 3:
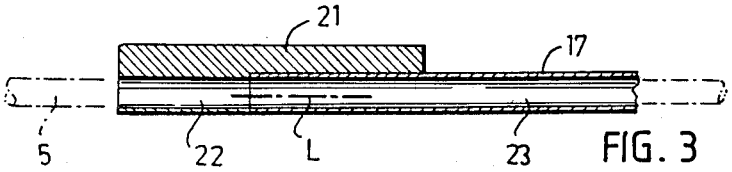
FIGS. 3 and 4 illustrate the outer end of the traverse arm and the eccentric element in an axial cross-section and in a side view respectively.
Figure 4:
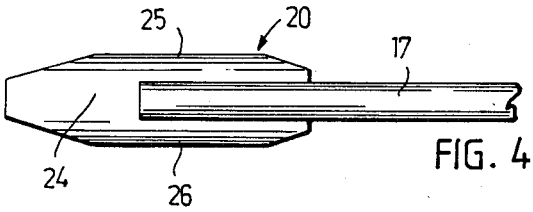

FIG. 1 of the drawings illustrates a distributor which comprises a base 1, in which a vertically displaceable adjusting column 2 is mounted, which column supports a horizontally displaceable traversing carriage 3. Said carriage supports a feeding device 4 for a cable 5 to be wound and a guiding device 6, which is pivotable around both a vertical 7 and a horizontal 8 shaft in a manner similar to a universal joint. The guiding device guides the cable to be wound on a reel 9 comprising a drum 10 and two flanges 11, 12. This type of construction and operation of a distribution equipment are principally previously known in connection with cable winding, e.g. from said U.S. Patent, on account of which the construction and operation will not be described more closely here.

The guiding device 6 comprises a sleeve-like support 13, which is mounted on the carriage 3 by means of a fork-like retainer 14. Said retainer is pivotable around the vertical axle 7 by means of a pressure medium cylinder 15. A supporting bushing 16 is rotatably mounted inside the support and a traverse tube 17 is fastened to said bushing co-axially with the axis of rotation of the supporting bushing. An external tooth ring 18 is fastened to said supporting bushing and a rotating motor 19 is mounted on the support 13 in engagement with said tooth ring.

A guide head 20 is fastened at the outer end of the traverse tube, said guide head comprising an eccentric element 21 which is provided with a guide hole 22 co-axial with the traverse tube. The diameter D of said hole corresponds to the diameter of the axial hole 23 of the traverse tube. Said eccentric element further comprises a cylindrical guide surface 24, the radius R of which equals to one and a half times the diameter of the guide hole and the centre of which is displaced from the centre of the guide hole by a distance essentially equal to the diameter of the guide hole so that the guide surface nearly contacts the outer periphery of the guide hole with a small wall thickness. The eccentric element thus forms two diametrally opposite guide cams 25, 26. Both ends of the eccentric element are formed with bevelled surfaces.

The diameter of the axial hole of the traverse tube exceeds the diameter of the cable to be wound only so much that it is possible for the cable to slide easily through the tube. The centre line of the hole of the tube thus forms the path of movement L along which the axis of the cable to be wound moves during the winding operation.

The winding of the cable is carried out as follows:

The cable is fed through the guiding device on the periphery of the drum of the reel and the head portion of the cable is pushed through a hole 11*a* provided in the flange of the reel and is fastened to the flange. Thereafter, the reel is rotated simultaneously as the cable is fed by means of the guiding device on the surface of the drum of the reel. The guiding device is displaced in a manner known per se towards one flange during the winding of the cable on the reel. Close to the other flange the direction of movement of the guiding device is reversed so that the cable forms a further layer on the preceding one. In the vicinity of each of the two flanges, at a point where the last revolution of the lower layer runs up on said layer and forms the first revolution of the upper layer, the cable, which should form the second revolution of said upper layer, is liable to be wound up on said first revolution instead of being wound beside it. On account of this, the cable must be positively guided in the vicinity of each of the two flanges.

Figure 5:
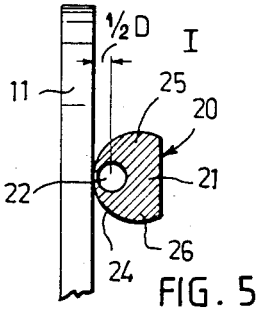
FIGS. 5 and 6 are cross-sections of the eccentric element of the traverse arm in two different rotation positions.
Figure 6:
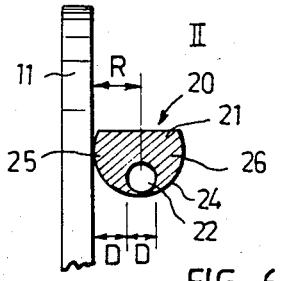
Figure 7A:
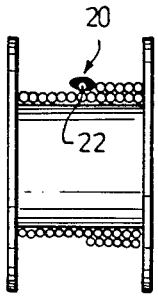
Figure 8A:
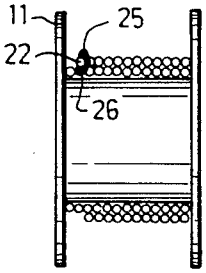
Figure 7B:
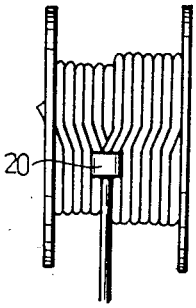
Figure 8B:
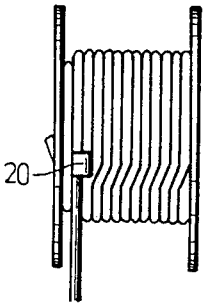

When the traverse tube of the guiding device approaches one flange of the reel, the rotating motor 19 rotates the guide head over an angle of 90° from the normal winding position illustrated in FIGS. 7A–7B, in which position the guide hole 22 of the eccentric element is in a lower position, to the position illustrated in FIGS. 8A–8B, in which position the guide hole is positioned towards the flange and both guide cams 25, 26 are positioned in a vertical plane. FIG. 5 is an enlarged view of said position I.

Figure 9A:
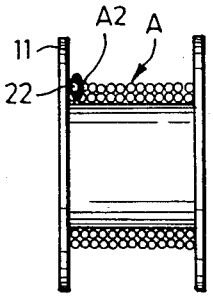
Figure 9B:
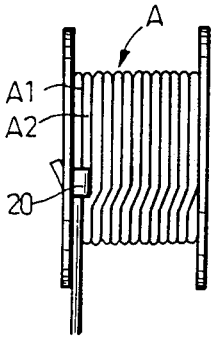

When the guide head has reached the flange, the eccentric element is pressed against the flange in a manner shown in FIGS. 9A–9B so that the guide hole is positioned immediately beside the flange. In this position, the guide head guides the cable to be wound between the last but one revolution A2 of the layer A on the reel and the flange 11 to form the last revolution A1 of said layer, said revolution A1 being positioned close to the flange.

Figure 10A:
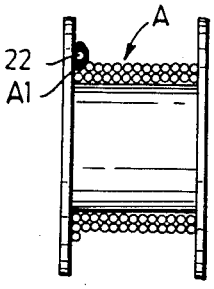
Figure 10B:
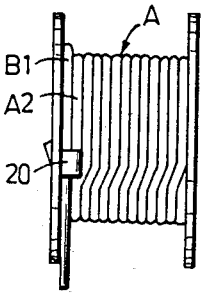

As the winding continues and the last revolution A1 is completed, the traversing device raises the traverse tube by the height of the diameter of the cable, whereby the position of the guide head remains unchanged, as shown in FIGS. 10A–10B. As the winding proceeds, the cable is thus guided up on the last revolution A1 to form the first revolution B1 of the second layer B so that said first revolution is positioned close to the flange.

Figure 11A:
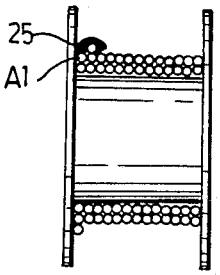
Figure 11B:
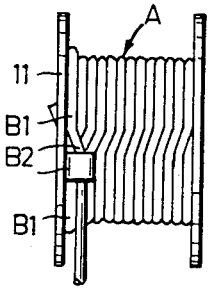

When the first revolution B1 has been completed, the rotating motor rotates the traverse tube over an angle of 90° back to the normal winding position. One guide cam 25 of the eccentric element is thereby turned against the flange to force the guide head to move in the horizontal plane away from the flange so that the guide hole is positioned at a distance equal to the diameter of the cable from the preceding position. The new position of the guide head is shown in FIGS. 11A–11B. The guide head thereby deviates the cable sidewards an amount equal to the diameter of the cable so that the cable is not wound up on said first revolution B1 but beside it to form the second revolution B2 of the second layer B.

Figure 12A:
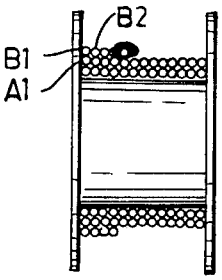
Figure 12B:
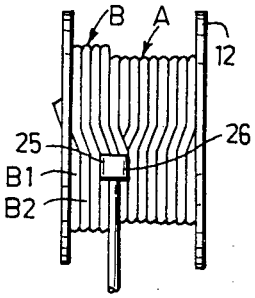

When the second revolution B2 has been completed, the traversing device again displaces the guide head a distance equal to the diameter of the cable away from the flange, whereby the guide head is released from contact with the flange. The revolutions of the second layer have thus been properly started and the guide head continues the guiding operation by means of the normal distribution control of the traversing device, as shown in FIGS. 12A–12B.

When the guide head is approaching the other flange of the reel, the rotating motor again rotates the guide head over an angle of 90° but this time in such a direction that the guide hole of the guide head is positioned towards the other flange 12. Thereafter, the operation is similar to that described above, and in the vicinity of the flange, the other guide cam 26 of the eccentric body is pressed against the flange 12 when the second revolution of the third layer is to be deviated to a distance equal to the diameter of the cable away from the flange.

The rotating and raising movements of the guiding device in the vicinity of the flanges are controlled synchronously with the rotating movement of the reel principally in the same manner as described in said U.S. Patent.

It is noted that by means of the described guide head a reliable automatic guiding is provided by the flange itself by virtue of a mechanical contact between the flange of the reel and the guide head when winding a cable in the vicinity of the flanges. This is of importance in ensuring a regular winding even on deformed reels. The eccentric element of the guide head is extremely steady and is by means of its bevelled surfaces able to give way for possible deformations or the like of the reel without being damaged; No moving or other easily damageable parts are required for the guide head nor any detectors sensing the position of the guide head with respect to the flange.

The drawings and the enclosed description are only intended to illustrate the idea of the invention. In details, the guide head according to the invention may vary within the scope of the claims. Accordingly, the traverse tube can be made expansive so as to enable a cable with an uneven surface to pass through the tube.

We claim:

1. A device for guiding movement of a cable onto a flanged reel, the guiding device comprising:

a support carriage;

arm means supported by the support carriage for movement laterally across the face of the reel, and forming a passageway for guiding the cable toward the reel; and a guide head connected to a forward end of the arm means, and including (i) an axial through bore for receiving the cable from the arm means and further guiding the cable toward the reel, (ii) an outside surface extending eccentrically relative to the axis of the through bore, and (iii) means connecting the guide head to the arm means for pivotal movement about the axis of the through bore between first and second pivotal positions, and for movement laterally with the arm means between a first lateral position to guide the cable onto the reel immediately adjacent a flange thereof to form a first cable winding of a cbale layer, and a second lateral position to guide the cable onto the reel immediately to the side of the first cable winding;

wherein when the guide head is in the first lateral and pivotal positions and the guide head pivots to the second pivotal position, the outside surface of the guide head moves against the reel flange and forces the guide head from the first lateral position to the second lateral position.

2. A device according to claim 1 wherein the guide head comprises an eccentric element, and the eccentric element includes a guide cam forming the eccentric outside surface of the guide head.

3. A device according to claim 2 wherein the eccentric element forms another guide cam, the guide cams of the eccentric element being on opposite sides of the through bore of the guide head.

4. A device according to claims 2 or 3 wherein the arm means comprises a tube including a cylindrical opening forming the passageway of the arm means.

5. A device according to claim 4 wherein the outside surface of the tube defines a first cylinder, and the outside eccentric surface of the guide head defines another cylinder tangential to the cylinder defined by the outside surface of the tube.

6. A device according to claim 5 wherein the through bore of the guide head is coaxial with and forms an extension of the passageway of the arm means.

7. A device according to claim 1 wherein:

the through bore has a diameter and defines an axis;

when the guide head is in the first pivotal position, the eccentric surface is transversely displaced from the axis of the through bore by a distance approximately equal to half the diameter of the through bore; and when the guide head is in the second pivotal position, the eccentric surface is transversely displaced from the axis of the through bore by a distance approximately equal to $1\frac{1}{2}$ times the diameter of the through bore.

8. A device according to claim 7 wherein the eccentric surface of the guide head defines a cylinder having (i) a radius equal to approximately $1\frac{1}{2}$ times the diameter of the through bore and (ii) an axis parallel to the axis of the through bore and displaced from the axis of the through bore by a distance equal to the diameter of the through bore.

9. A device for guiding movement of a cable onto a flanged reel, the guiding device comprising:

(A) a support carriage;

(B) arm means connected to the support carriage for movement laterally across the face of the reel and for pivotal movement about a first axis between first and second pivotal positions, the arm means forming a passageway for guiding the cable toward the reel;

(C) a guide head including (i) an axial through bore for receiving the cable from the arm means and further guiding the cable toward the reel, (ii) an outside surface extending eccentrically relative to the axis of the through bore, and (iii) means connecting the guide head to a forward end of the arm means for pivotal movement therewith about the axis of the through bore, and for movement laterally with the arm means between a first lateral position to guide the cable onto the reel immediately adjacent a flange thereof to form a first cable winding of a cable layer, and a second lateral position to guide the cable onto the reel immediately to the side of the first cable winding, wherein when the arm means is in the first pivotal position and the guide head is in the first lateral position and the arm means pivots to the second pivotal positon, the outside surface of the guide head moves against the reel flange and forces the guide head from the first lateral position to the second lateral positon; and (D) means connected to the arm means to pivot said arm means between the first and second pivotal positions.

* * * * *